US010369489B2

(12) United States Patent
McCurley

(10) Patent No.: US 10,369,489 B2
(45) Date of Patent: Aug. 6, 2019

(54) BUBBLE MAKER

(71) Applicant: Jonathan Cole McCurley, Piedmont, OK (US)

(72) Inventor: Jonathan Cole McCurley, Piedmont, OK (US)

( * ) Notice: Subject to any disclaimer, the term of this patent is extended or adjusted under 35 U.S.C. 154(b) by 6 days.

(21) Appl. No.: 15/854,719

(22) Filed: Dec. 26, 2017

(65) Prior Publication Data

US 2018/0178138 A1 Jun. 28, 2018

Related U.S. Application Data

(60) Provisional application No. 62/439,114, filed on Dec. 26, 2016.

(51) Int. Cl.
*A63H 33/28* (2006.01)

(52) U.S. Cl.
CPC ..... *A63H 33/28* (2013.01)

(58) Field of Classification Search
CPC ..... A63H 33/28
See application file for complete search history.

(56) References Cited

U.S. PATENT DOCUMENTS

| | | | | | |
|---|---|---|---|---|---|
| 2,912,790 | A * | 11/1959 | Weeber | A63H 33/28 | 446/18 |
| 4,995,844 | A * | 2/1991 | McNett | A63H 33/28 | 446/15 |
| 6,077,143 | A * | 6/2000 | Gutierrez | A63H 33/28 | 446/15 |
| 2015/0343322 | A1* | 12/2015 | Beavers | A63H 33/28 | 446/15 |
| 2016/0158663 | A1* | 6/2016 | Fogarty | A63H 33/28 | 446/15 |

* cited by examiner

*Primary Examiner* — Eugene L Kim
*Assistant Examiner* — Christopher A Glenn

(57) ABSTRACT

A bubble maker simplifies the creation and distribution of bubbles. The bubble maker includes a mixing basin, a water-inlet tube, an air-inlet tube, a bubble outlet, and a water overflow outlet. The bubble maker does not require an external electric power source to drive the agitation for a mixture of the water and soap as Venturi effect is implemented via water pressure from an external water supply through the water-inlet tube into the air-inlet tube to aerate the water and soap mixture and produce bubbles. The bubble maintains a maximum water level within the mixing basin with a water overflow outlet that allows for sufficient headspace for bubbles to accumulate within the mixing basin. As the bubbles accumulate within the mixing basin, the bubbles flow out of the bubble maker through the bubble outlet.

9 Claims, 12 Drawing Sheets

BUBBLE MAKER

The current application claims a priority to the U.S. Provisional Patent application Ser. No. 62/439,114 filed on Dec. 26, 2016.

FIELD OF THE INVENTION

The present invention relates generally to a bubble production apparatus. More specifically, the present invention relates to a bubble production apparatus which comprises a water delivery mechanism that utilizes the Venturi effect to regulate the production of bubbles.

BACKGROUND OF THE INVENTION

Bubbles and suds are utilized for a plurality of purposes, such as cleaning, thoroughly mixing solutions, and entertainment. A constant production of bubbles, however, is limited given the current tools and toys that produce bubbles. Toy bubble guns that produce bubbles requires consistent manual input. Meanwhile, decorations that produce bubbles and bubble generators require an external power source, in addition to an external water source, to agitate the water and soap solution to produce the bubbles.

The present invention is a bubble maker that simplifies the creation and distribution of bubbles. Within a mixing basin, a quantity of soap is agitated from water flow into the mixing basin through a water inlet tube to produce bubbles. The present invention does not require an external electric power source to drive the agitation for mixture of the water and soap, as the present invention utilizes the Venturi effect via water pressure from an external water supply to aerate the water and soap mixture, in order to produce bubbles. The present invention maintains a maximum water level within the mixing basin through a water overflow outlet to allow for a sufficient headspace for bubbles to accumulate within the mixing basin. As the bubbles accumulate, the bubbles rise within the mixing basin and flow out through a bubble outlet.

DETAIL DESCRIPTIONS OF THE INVENTION

All illustrations of the drawings are for the purpose of describing selected versions of the present invention and are not intended to limit the scope of the present invention.

The present invention is a bubble maker. The present invention is an apparatus for the continuous production of bubbles for entertainment, cleaning, and thoroughly mixing solutions. The present invention operates without input from an external electrical power source. Bubbles are generated through water flow through the present invention as the water is aerated and then mixed with a quantity of soap.

Figure 1:
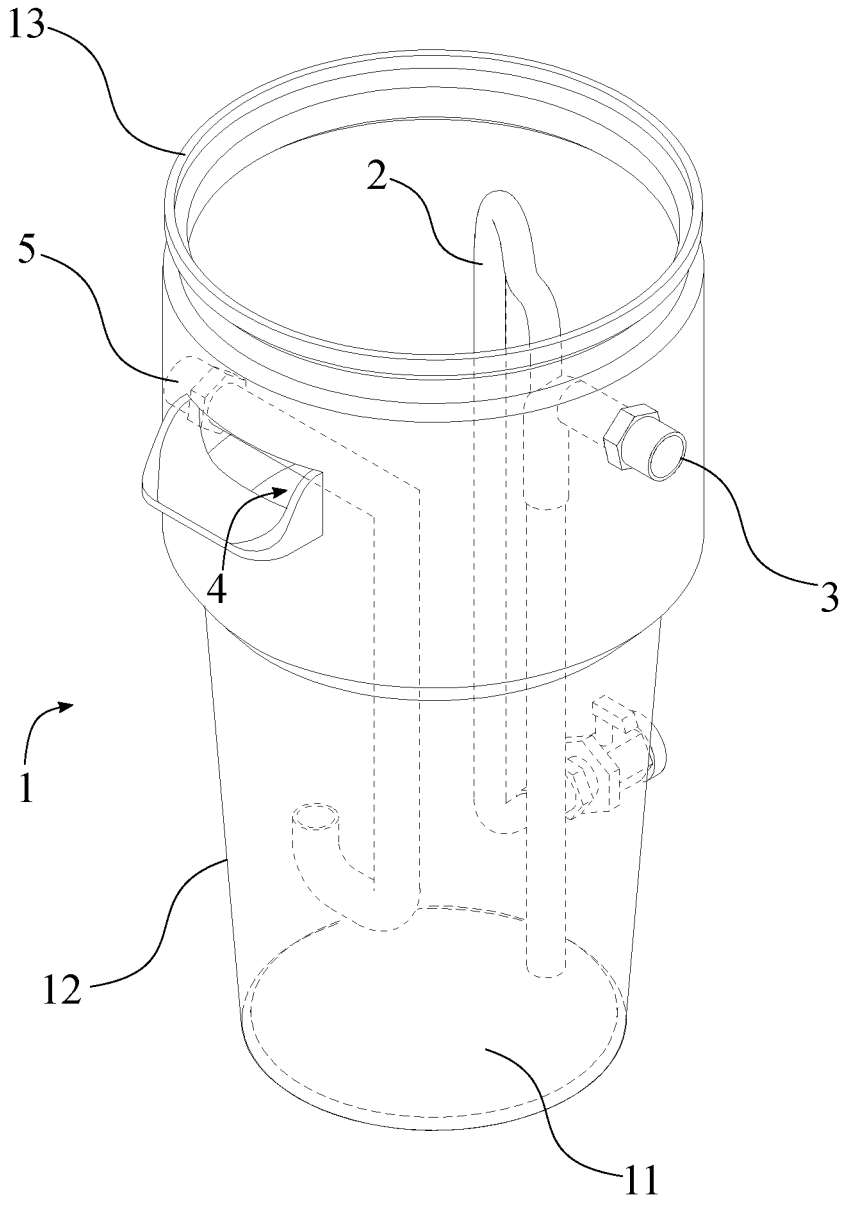
FIG. 1 is a perspective view of the present invention, exemplifying the water-inlet tube, and the air-inlet tube within the mixing basin.
Figure 2:
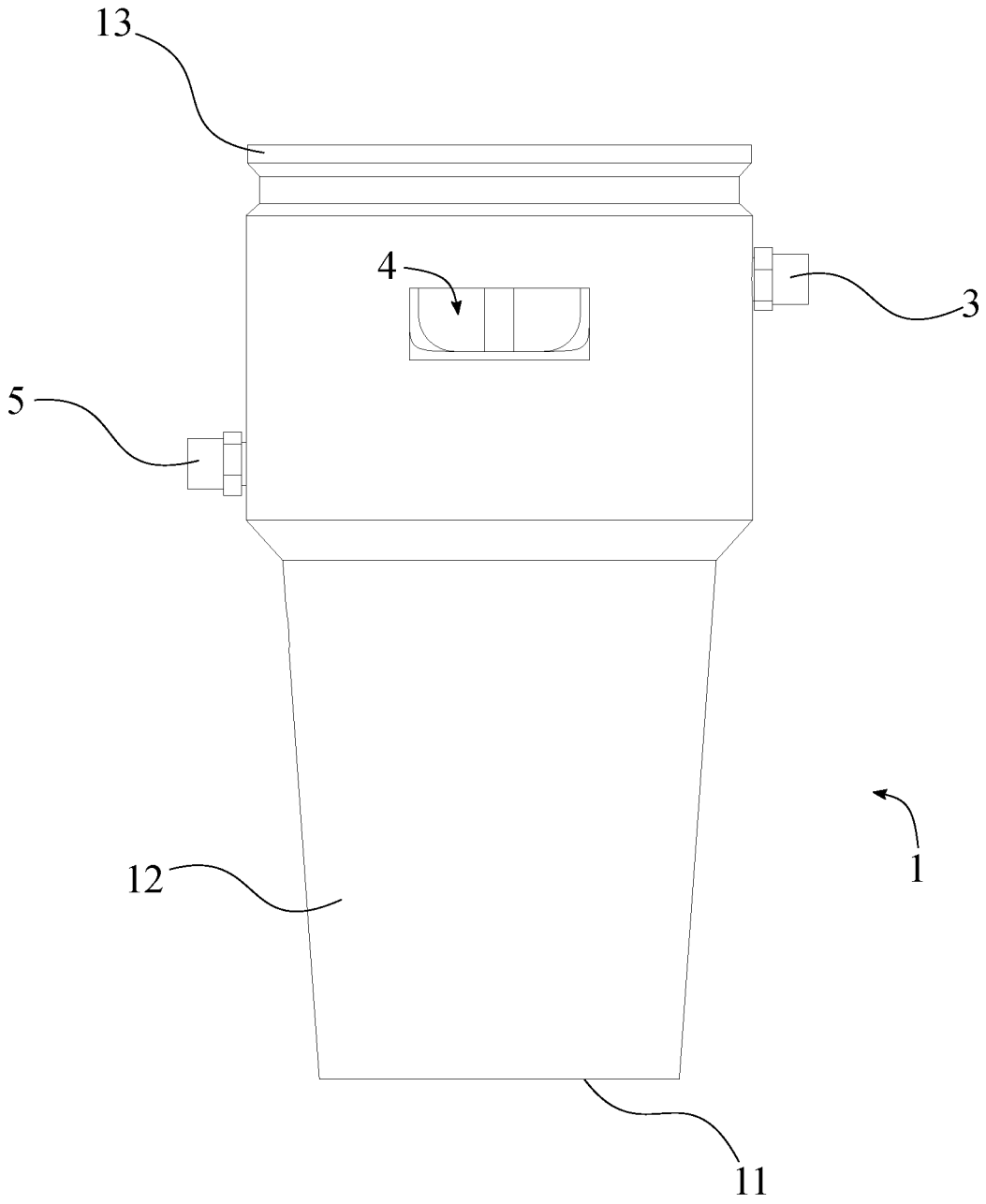
FIG. 2 is a front view of the present invention.
Figure 3:
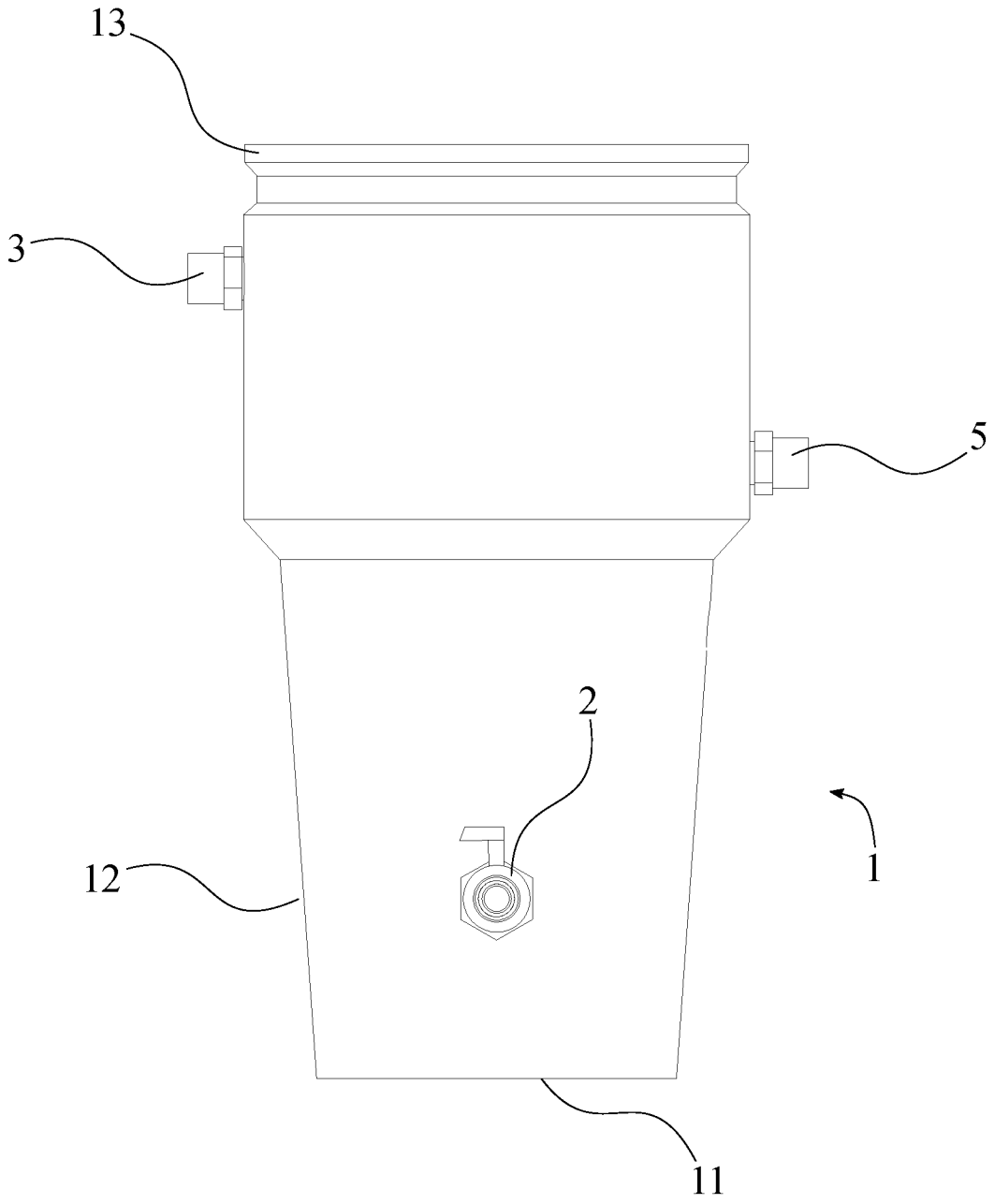
FIG. 3 is a rear view of the present invention.
Figure 4:
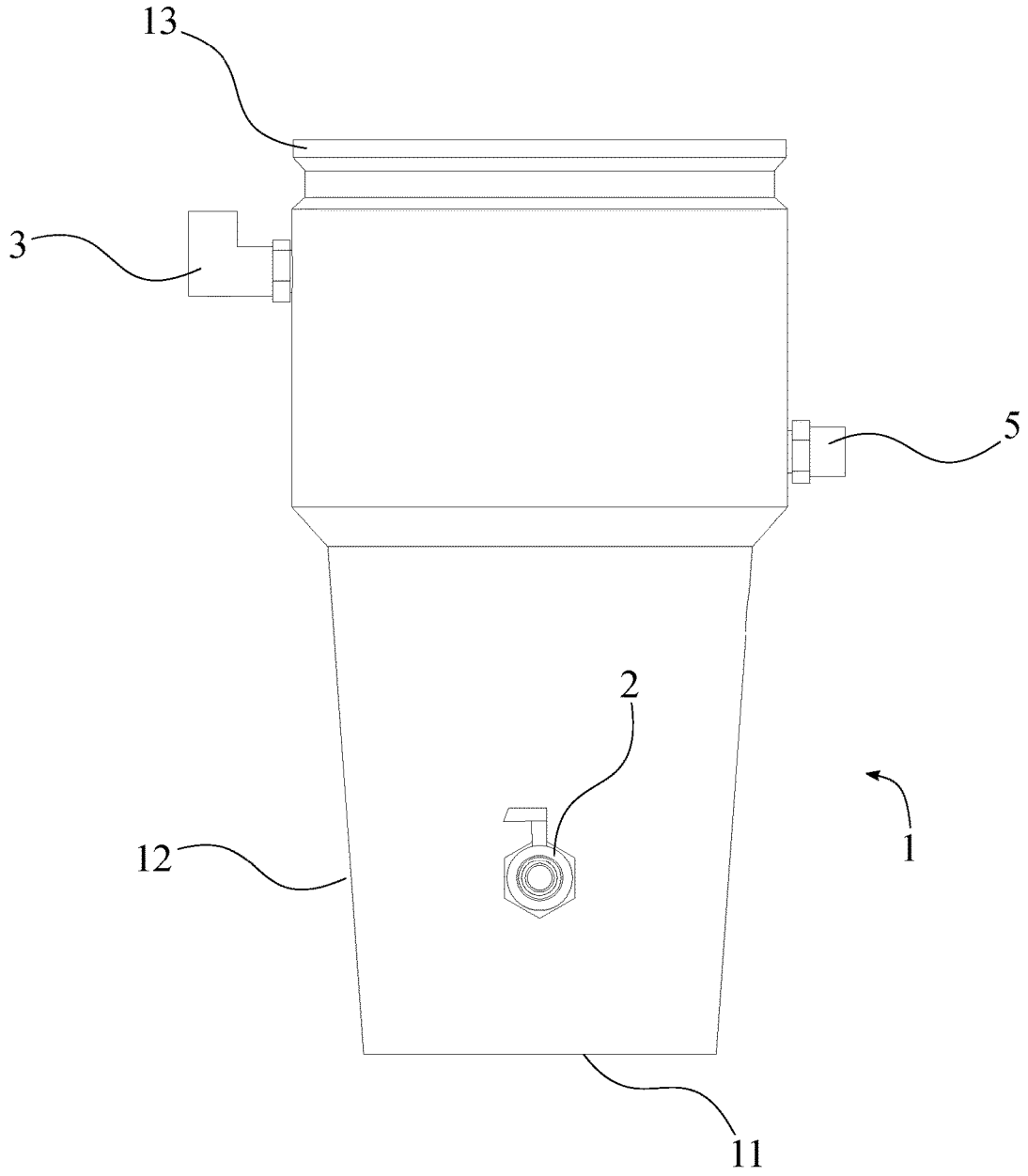
FIG. 4 is a rear view for an alternate embodiment of the present invention, wherein the air-inlet tube is oriented away from the basin base.
Figure 5:
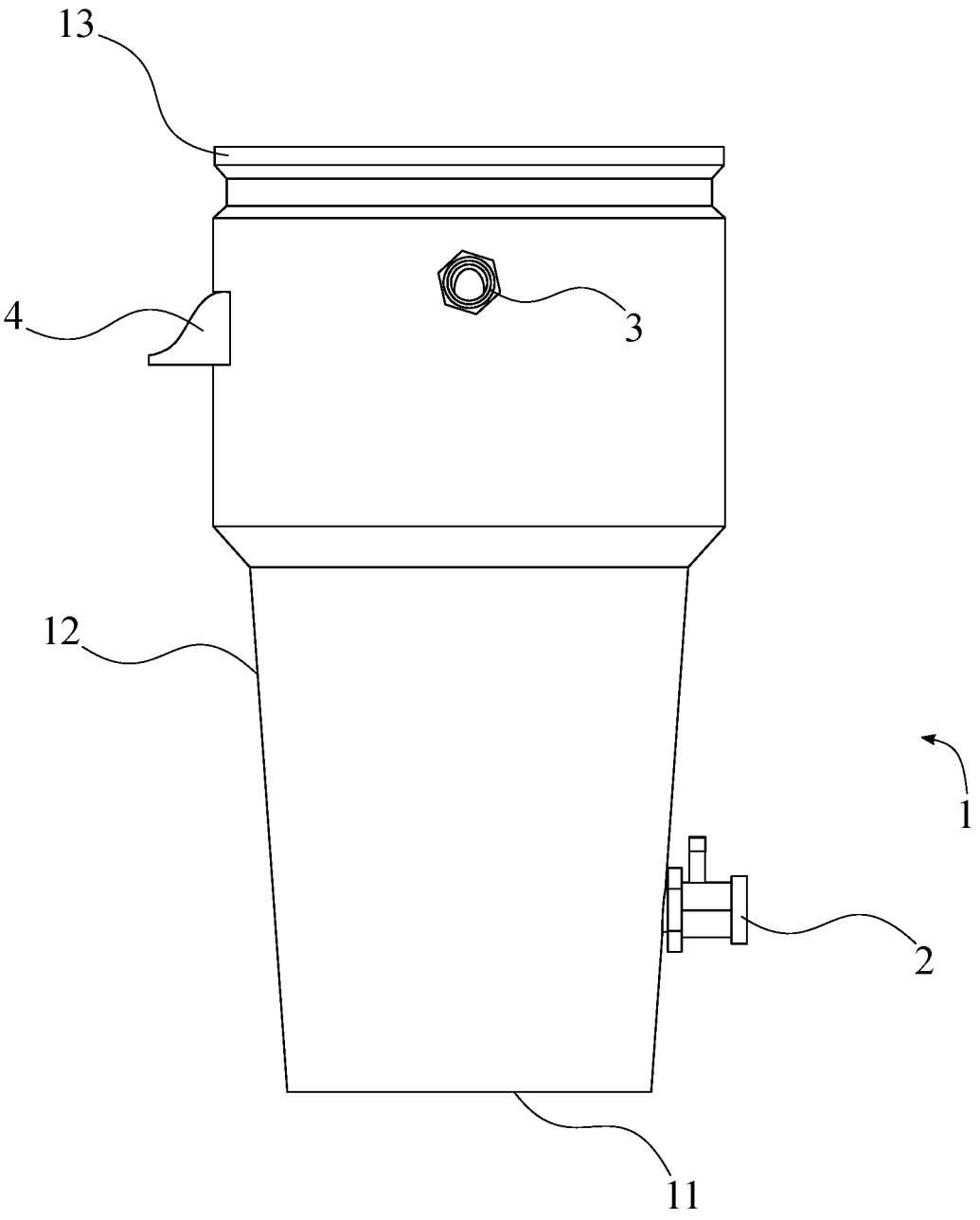
FIG. 5 is right view of the present invention.
Figure 6:
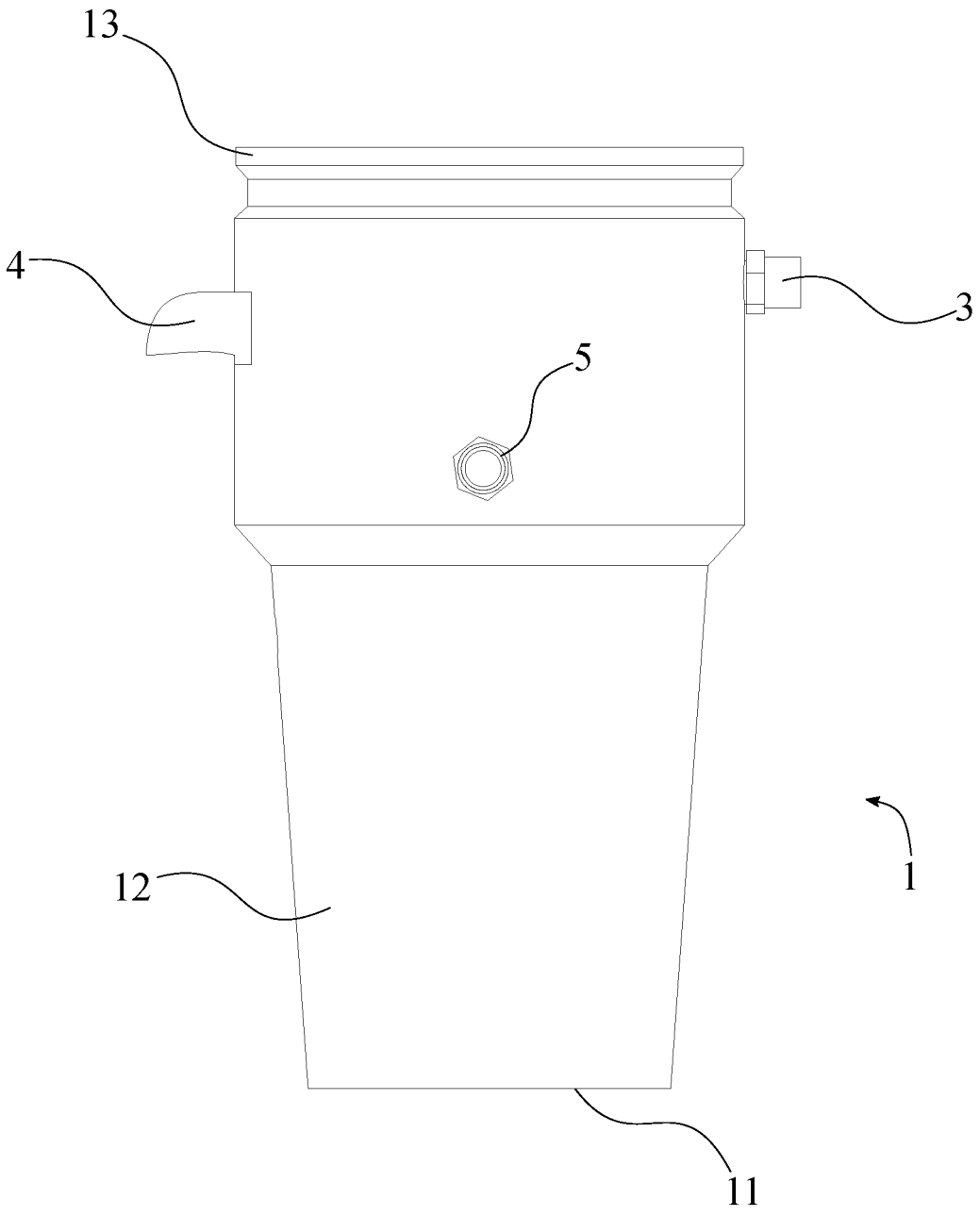
FIG. 6 is a right view for an alternate embodiment of the present invention, wherein the bubble outlet is oriented towards the basin base.
Figure 7:
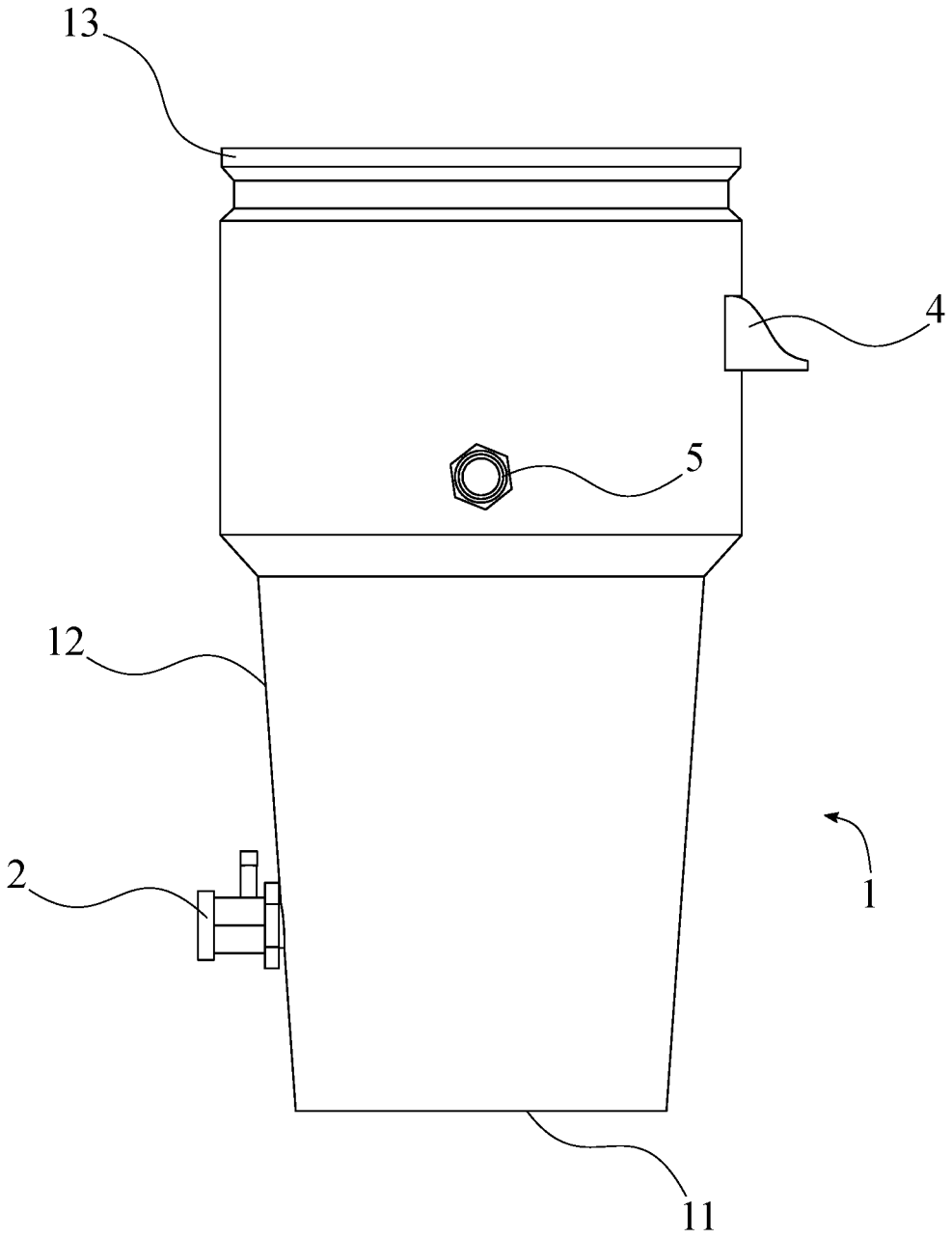
FIG. 7 is a left view of the present invention.
Figure 8:
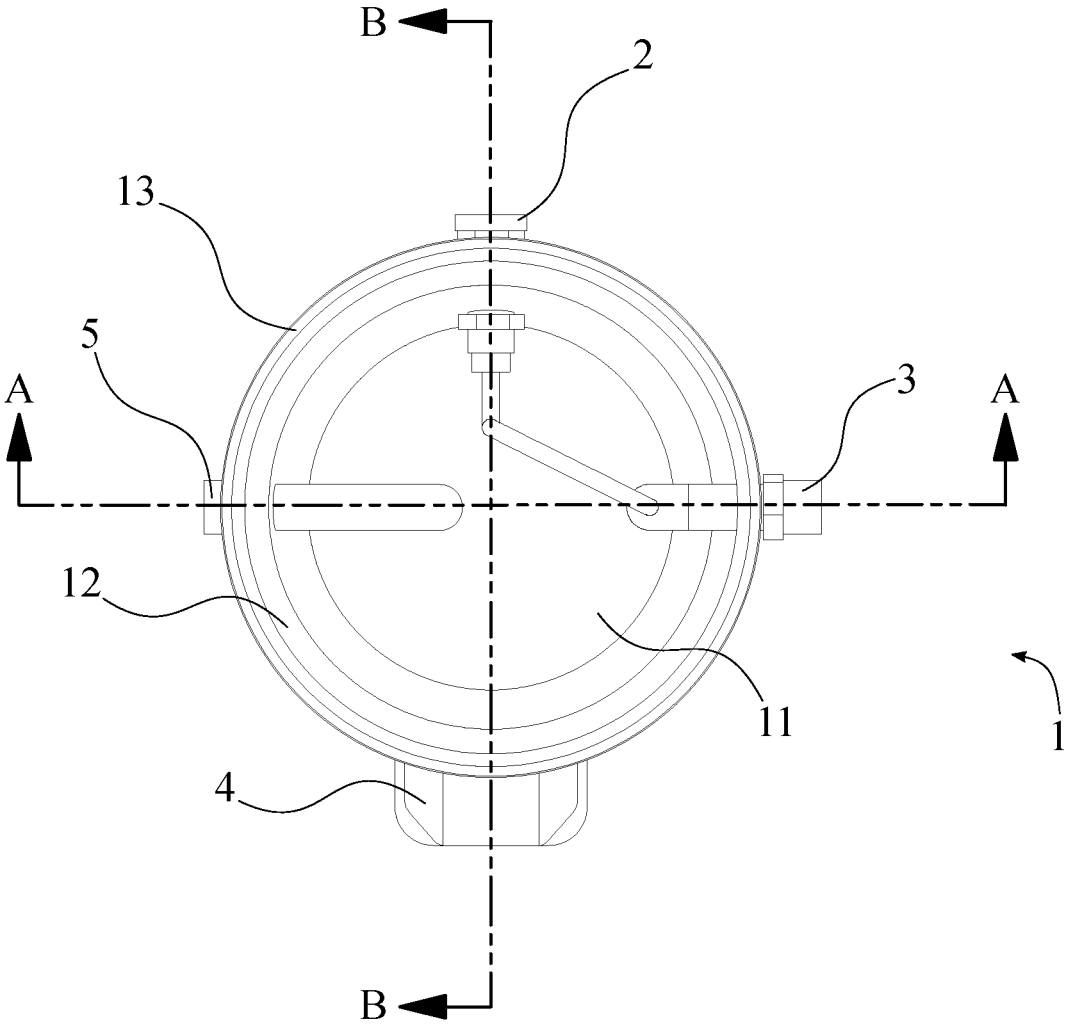
FIG. 8 is a top view of the present invention.
Figure 9:
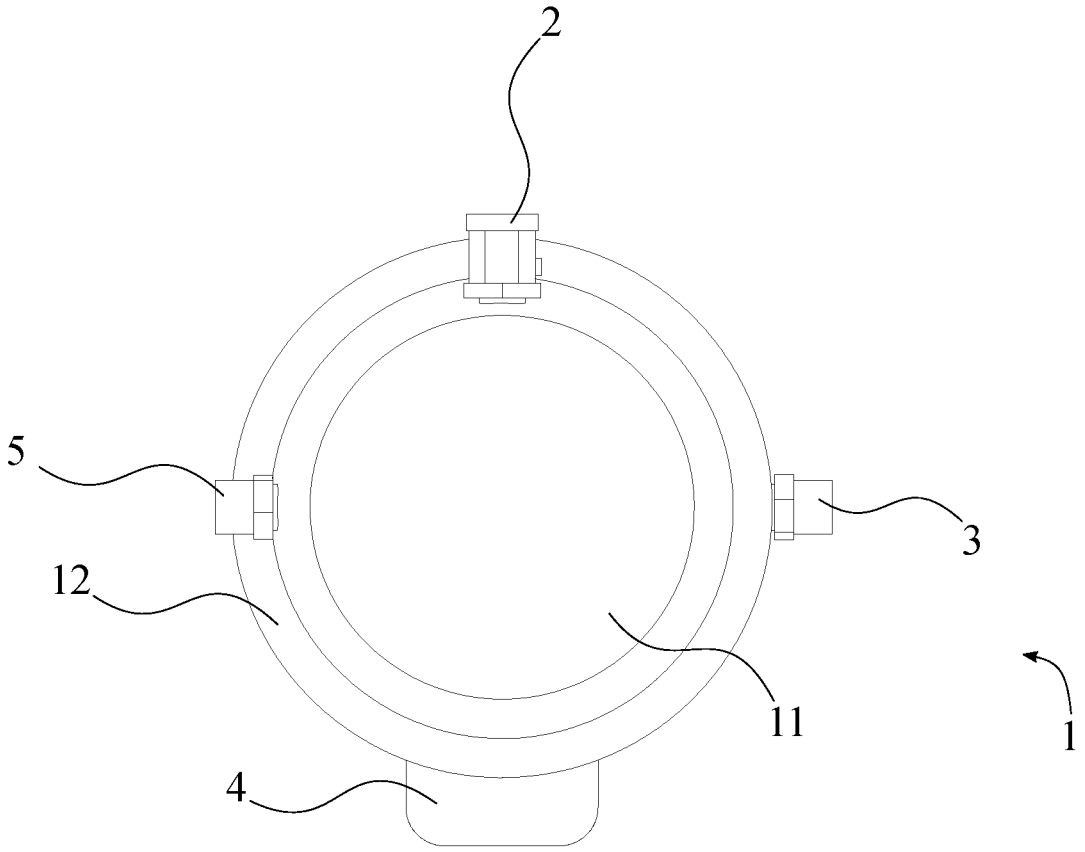
FIG. 9 is a bottom view of the present invention.

In accordance to FIG. 1, the present invention comprises a mixing basin 1, a water-inlet tube 2, an air-inlet tube 3, a bubble outlet 4, and a water overflow outlet 5. The mixing basin 1 is a vessel that receives a stream of water, a stream of air, and a quantity of soap for the production of bubbles. The mixing basin 1 comprises a basin base 11 and a lateral wall 12. The basin base 11 and the lateral wall 12 define the volume of the mixing basin 1; the lateral wall 12 being perimetrically connected to the basin base 11 to delineate the volume of the mixing basin 1, as shown in FIG. 1, FIG. 8, and FIG. 9. The air-inlet tube 3 traverses through the lateral wall 12 to allow for the stream of air to enter the mixing basin 1. Similarly, the water-inlet tube 2 traverses through the lateral wall 12 and into the air-inlet tube 3 to allow for the stream of water from an external water source to enter the air-inlet tube 3. As the stream of water flows into the air-inlet tube 3, a pressure differential creates suction to draw the stream of air through the air-inlet tube 3 and mix with the stream of water that discharges into the mixing basin 1. The quantity of soap may be deposited within the mixing basin 1 prior to the stream of water, introduced into the mixing basin 1 while the stream of water is flowing into the mixing basin 1, or introduced through the air-inlet tube 3 and drawn into the stream of water as the stream of water flows into the mixing basin 1. The quantity of soap is mixed and agitated with the stream of the mixture of water and air to produce bubbles. The bubble outlet 4 traverses through the lateral wall 12 to allow the bubbles to discharge from the mixing basin 1, as shown in FIG. 8. In some embodiments of the present invention, the bubble outlet 4 is oriented away from the basin base 11 to allow bubbles to egress away from the basin base 11, as shown in FIG. 5. In some other embodiments of the present invention, the bubble outlet 4 is oriented towards the basin base 11 to allow bubbles to egress towards the basin base 11, as shown in FIG. 6. The water overflow outlet 5 traverses through the lateral wall 12 to allow the discharge of water from the mixing basin 1, as shown in FIG. 8. The water overflow outlet 5 prevents the water level within the mixing basin 1 from filling the entirety of the volume of the mixing basin 1 to provide headspace to produce bubbles. As such, the water overflow outlet 5 is positioned between the bubble outlet 4 and the basin base 11, along the lateral wall 12 to provide sufficient headspace within the mixing basin 1, as detailed in FIG. 2.

Figure 10:
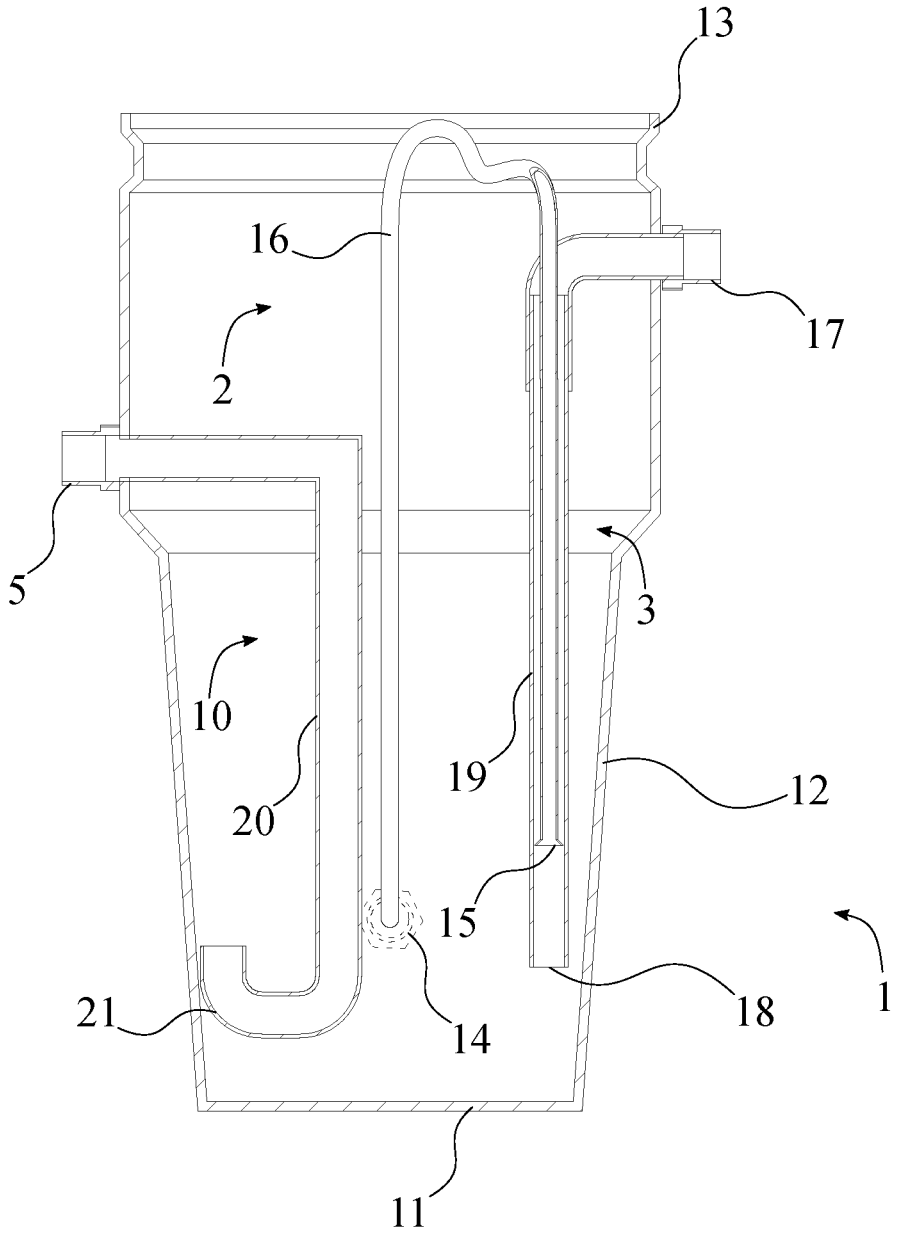
FIG. 10 is a cross-sectional view of the present invention, along the line A-A of FIG. 8.

Further in accordance to the preferred embodiment of the present invention, the air-inlet tube 3 comprises an air-inlet fitting 17, an air-outlet fitting 18, and an air conduit 19, detailed in FIG. 10. The air-inlet fitting 17 allows for the connection of an air source to provide access to the stream of air. The air-outlet fitting 18 is the discharge location of the stream of the mixture of water and air into the mixing basin 1. The air conduit 19 directs the stream of air between the air-inlet fitting 17 and the air-outlet fitting 18. The air-inlet fitting 17 is opposite to the air-outlet fitting 18, along the air conduit 19. The air-inlet fitting 17 is externally and adjacently connected to the lateral wall 12. The air conduit 19 traverses through the lateral wall 12. The air-outlet fitting 18 is internally positioned to the lateral wall 12. The air-inlet fitting 17 is in fluid communication with the water-outlet fitting 18 through the air conduit 19, in order to allow air to flow from an external air source into the mixing basin 1.

Similarly, the water-inlet tube 2 comprises a water-inlet fitting 14, a water-outlet fitting 15, and a water conduit 16, as shown in FIG. 10. The water-inlet fitting 14 allows for the connection of a water source to provide access to the stream of water. The water-outlet fitting 15 is the discharge location of the stream of water into the air-inlet tube 3. The water conduit 16 directs the stream of water between the water-inlet fitting 14 and the water-outlet fitting 15. The water-inlet fitting 14 is opposite to the water-outlet fitting 15, along the water conduit 16. The water-inlet fitting 14 is externally and adjacently connected to the lateral wall 12, in accordance to FIG. 11. The water conduit 16 traverses through the lateral wall 12. In some embodiments of the present invention, the water conduit 16 sealably traverses through the lateral wall 12 to prevent water within the mixing basin 1 from leaking around the water conduit 16, wherein the water-inlet fitting is positioned between the water overflow outlet 5 and the basin base 11. The water-outlet fitting 15 is internally positioned to the lateral wall 12. The water-inlet fitting 14 is in fluid communication with the air-inlet tube 3 through the water conduit 16 and the water-outlet fitting 15, in order to allow water to flow from an external water source into the air-inlet tube 3.

More specifically, the water conduit 16 traverses into the air conduit 19. The water-outlet fitting 15 is concentrically positioned within the air conduit 19, between the air-inlet fitting 17 and the air-outlet fitting 18, in accordance to FIG. 10. In this configuration, low pressure would be generated slightly upstream of the water-outlet fitting 15 within the air conduit 19 from the stream of water. The low pressure facilitates the flow of the stream of air mixing into the stream of water. The water-outlet fitting 15 is preferred to be flared at forty-five degrees from the water conduit 16 to reduce the clearance between the water-outlet fitting 15 and the air conduit 19. Constricting the air conduit 19 increases the volumetric flowrate for the stream of air to generate the pressure difference.

Figure 11:
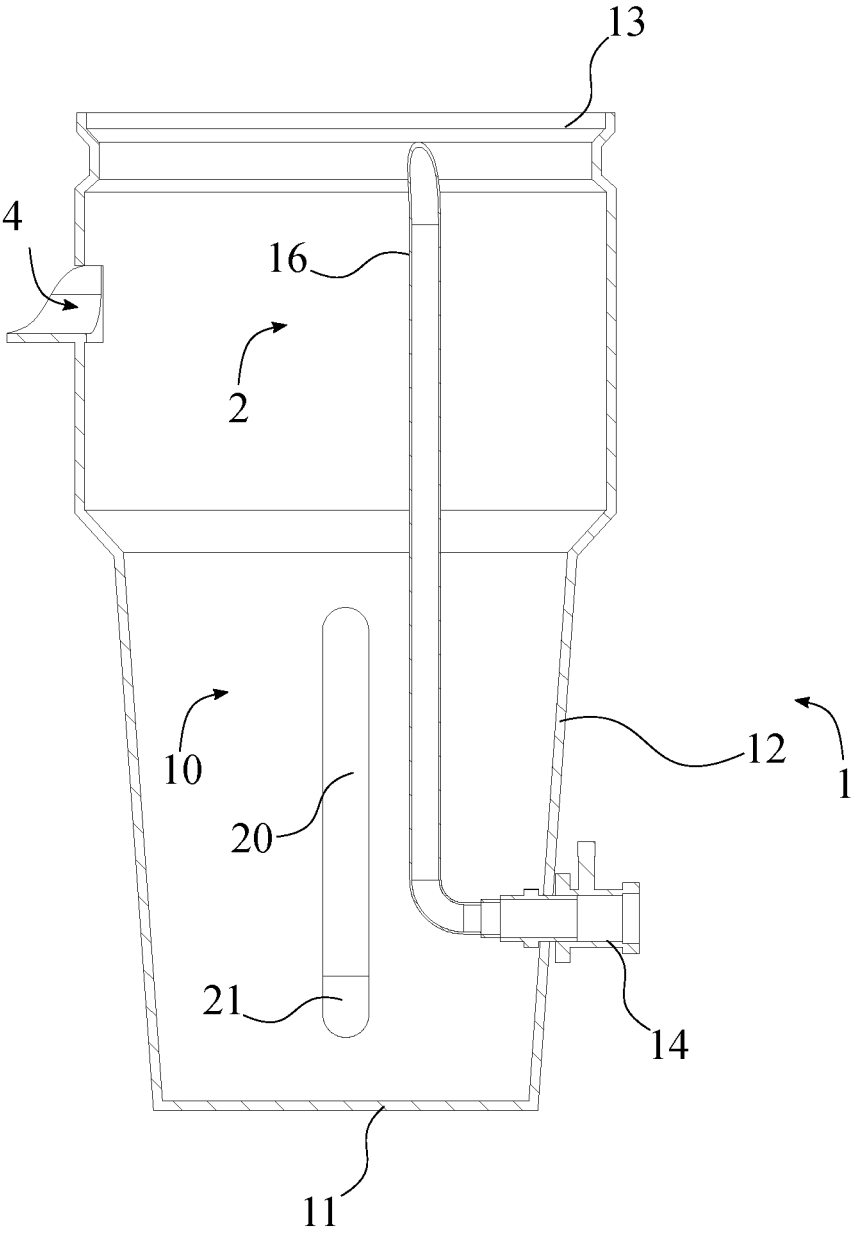
FIG. 11 is a cross-sectional view of the present invention, along the line B-B of FIG. 8.
Figure 12:
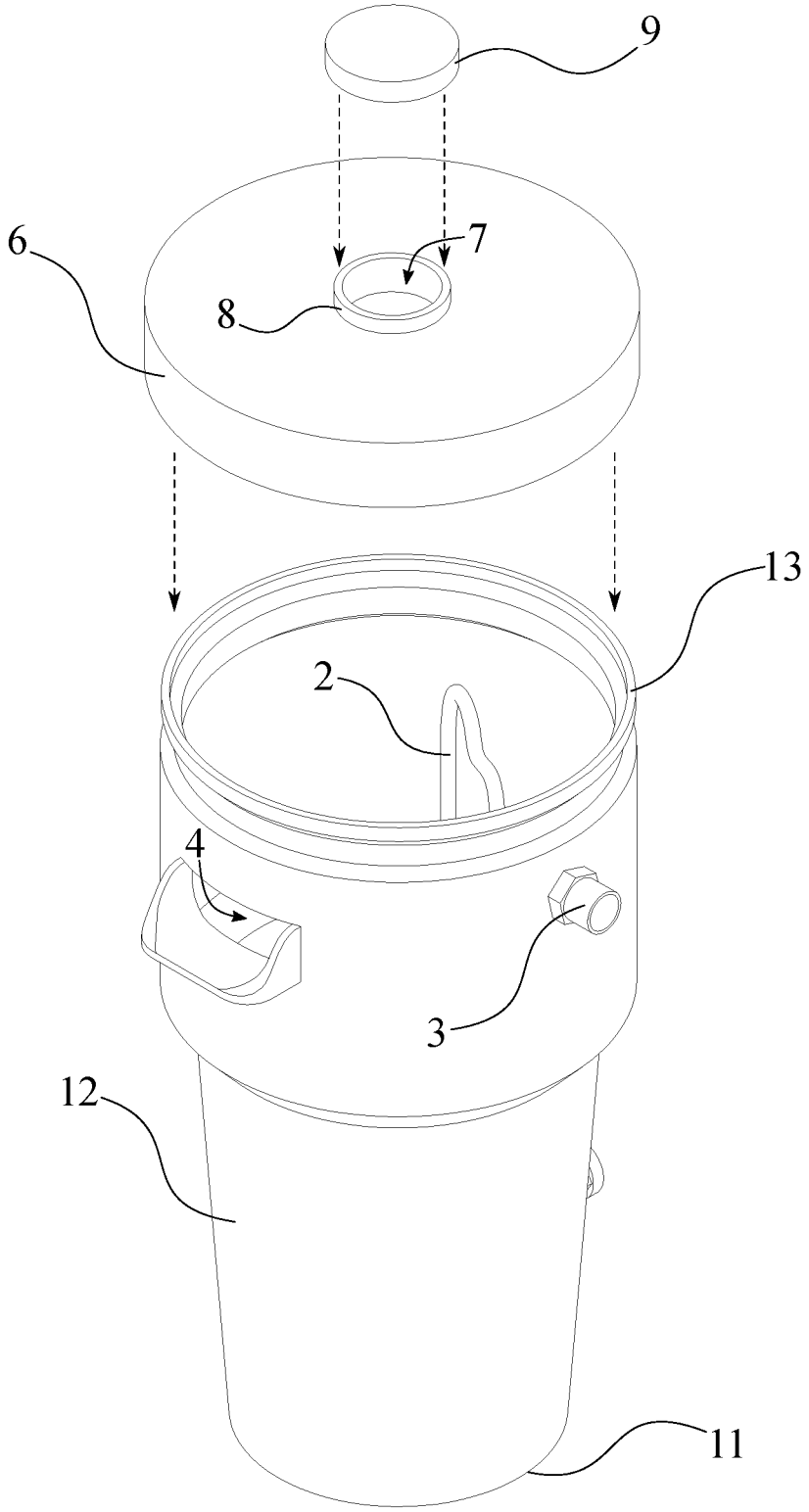
FIG. 12 is a perspective view of the present invention, exemplifying the water-inlet tube, and the air-inlet tube within the mixing basin.

Further in accordance to the preferred embodiment of the present invention, the present invention comprises a basin lid 6 and the mixing basin 1 further comprises a lid-receiving lip 13, as shown in FIG. 12. The basin lid 6 encloses the mixing basin 1 to contain the production of bubbles within the mixing basin 1 and direct the flow of bubbles into the bubble outlet 4. The lid-receiving lip 13 is perimetrically connected to the lateral wall 12. The lid-receiving lip 13 is oppositely positioned to the basin base 11, along the lateral wall 12, as shown in FIG. 1 to FIG. 7 and FIG. 10 to FIG. 12. The basin lid 6 perimetrically engages the lid-receiving lip 13 to enclose the mixing basin 1.

In some embodiments of the present invention, the present invention comprises a soap dispensing hole 7, detailed in FIG. 12. The soap dispensing hole 7 allows for the injection of the quantity of soap to maintain the production of bubbles within the mixing basin 1. The soap dispensing hole 7 centrally traverses through the basin lid 6. More specifically, the present invention further comprises a dispensing hole lip 8 and a dispensing hole cap 9. The dispensing hole lip 8 allows for the attachment and removal of the dispensing hole cap 9 for the user to access the soap dispensing hole 7. The dispensing hole cap 9 seals the soap dispensing hole 7 to prevent contaminants from being introduced into the mixing basin 1. The dispensing hole lip 8 is perimetrically integrated with the basin lid 6 around the soap dispensing hole 7. The dispensing hole cap 9 perimetrically engages the dispensing hole lip 8 in order to seal the soap dispensing hole 7 from external contaminants. When the basin lid 6 engages the lid-receiving lip 13, the dispensing hole lip 8 is preferred to be oriented away from the basin base 11 to allow the user to quickly position the dispensing hole cap 9 about the dispensing hole lip 8. The dispensing hole cap 9 preferably engages the dispensing hole lip 8 through a threaded connection, a snap-fit connection, press-fit connection, or any similar appropriate mechanical fastening mechanism. These mechanical fastening mechanisms allow the dispensing hole cap 9 to be easily removed from the dispensing hole lip 8, allow the user to access the soap dispensing hole 7 to charge the mixing basin 1 with the quantity of soap, and allow the dispensing hole cap 9 to form a seal with the dispensing hole lip 8.

Further in accordance to the preferred embodiment of the present invention, the present invention comprises a water trap 10, detailed in FIG. 10 and FIG. 11. The water trap 10 prevents bubbles from egressing through the water overflow outlet 5. The water trap 10 is positioned within the mixing basin 1 in order to provide a conduit for the overflow water to flow into and subsequently out from the water overflow outlet 5. The water trap 10 comprises a trap conduit 20 and a trap inlet 21. The trap inlet 21 is in fluid communication with the water overflow outlet 5 through the trap conduit 20. The trap inlet 21 is oriented away from the basin base 11 to prevent bubbles from entering the water trap 10 during production. The trap inlet 21 is positioned between the water overflow outlet 5 and the basin base 11 such that the trap inlet 21 is submerged within the water of the mixing basin 1 when the water level is at the maximum height. Due to the height of the water within the mixing basin 1, bubbles rise past the trap inlet 21 while water flows into the trap inlet 21, the trap conduit 20, and out from the water overflow outlet 5.

In implementation of the present invention, the user may add water or soap into the mixing basin 1. To add water into the mixing basin 1, the user connects an external water supply to the water-inlet tube 2, more specifically to the water-inlet fitting 14. To introduce soap into the water basin 1, the user directly adds soap through an opening in the lateral wall 12 opposite to the basin base 11, through the soap dispensing hole 7, or through the air-inlet tube 3. The flow of the stream of water draws in air as the stream of water enters the air conduit 19 through the Venturi effect, creating a stream of air and water. The stream of air and water agitates the soap to produce bubbles within the mixing basin 1. Excess water egresses through the water overflow outlet 5 to maintain the water level within the mixing basin 1. The bubbles egress through the bubble outlet 4 when the bubbles reach the height of the bubble outlet 4.

Although the invention has been explained in relation to its preferred embodiment, it is to be understood that many other possible modifications and variations can be made without departing from the spirit and scope of the invention as hereinafter claimed.

What is claimed is:

1. A bubble maker comprising:

a mixing basin;

a water inlet tube;

an air inlet tube;

a bubble outlet;

a water overflow outlet;

the mixing basin comprising a basin base and a lateral wall;

the lateral wall being perimetrically connected to the basin base;

the air inlet tube traversing through the lateral wall;

the water inlet tube traversing through the lateral wall;

the water inlet tube traversing into the air inlet tube;

the water inlet tube comprising a water inlet fitting, a water outlet fitting and a water conduit;

the water inlet fitting being opposite to the water outlet fitting along the water conduit;

the water inlet fitting being externally and adjacently connected to the lateral wall;

the water conduit traversing through the lateral wall;

the water outlet fitting being internally positioned to the lateral wall;

the air inlet tube comprising an air inlet fitting, an air outlet fitting and an air conduit;

the air inlet fitting being opposite to the air outlet fitting along the air conduit;

the air inlet fitting being externally and adjacently connected to the lateral wall;

the air conduit traversing through the lateral wall;

the air outlet fitting being internally positioned to the lateral wall;

the water conduit traversing into the air conduit;

the water outlet fitting being concentrically positioned within the air conduit;

the water outlet fitting being positioned in between the air inlet fitting and the air outlet fitting;

the water outlet fitting being adjacently located to the air outlet fitting;

the bubble outlet traversing through the lateral wall;

the water overflow outlet traversing through the lateral wall;

the water overflow outlet being positioned in between the bubble outlet and the basin base; and the water overflow outlet being positioned along the lateral wall.

2. The bubble maker, as claimed in claim 1, wherein the water outlet fitting is flared at forty-five degrees from an end of the water conduit.

3. The bubble maker, as claimed in claim 1, comprising:

a basin lid;

the mixing basin comprising a lid-receiving lip;

the lid-receiving lip being perimetrically connected to the lateral wall;

the lid-receiving lip being oppositely positioned to the basin base;

the lid-receiving lip being positioned along the lateral wall; and the basin lid perimetrically engaging the lid-receiving lip.

4. The bubble maker, as claimed in claim 3, comprising:

a soap dispensing hole; and the soap dispensing hole centrally traversing through the basin lid.

5. The bubble maker, as claimed in claim 4, comprising:

a dispensing hole lip;

a dispensing hole cap;

the dispensing hole lip being perimetrically integrated with the basin lid around the soap dispensing hole; and the dispensing hole cap perimetrically engages the dispensing hole lip.

6. The bubble maker, as claimed in claim 1, comprising:

a water trap;

the water trap comprising a trap conduit and a trap inlet;

the water trap being positioned within the mixing basin;

the trap inlet being in fluid communication with the water overflow outlet through the trap conduit; and the trap inlet being oriented away from the basin base.

7. The bubble maker, as claimed in claim 6, comprising:

the trap inlet being positioned between the water overflow outlet and the basin base.

8. The bubble maker, as claimed in claim 1, wherein the bubble outlet is oriented towards the basin base.

9. The bubble maker, as claimed in claim 1, wherein the bubble outlet is oriented away from the basin base.

* * * * *